United States Patent [19]

Strausheim

[11] Patent Number: 4,674,240

[45] Date of Patent: Jun. 23, 1987

[54] WALL PANEL SYSTEM

[75] Inventor: Myron A. Strausheim, Richmond, Ind.

[73] Assignee: American Desk Manufacturing Company, Temple, Tex.

[21] Appl. No.: 857,989

[22] Filed: May 1, 1986

[51] Int. Cl.[4] ..... E04C 1/10; G09F 7/18

[52] U.S. Cl. ..... 52/36; 52/542; 52/588; 52/779; 211/189

[58] Field of Search ..... 52/36, 588, 738, 774, 52/779, 630, 729, 536, 537, 538, 542; 211/189

[56] References Cited

U.S. PATENT DOCUMENTS

| | | | |
|---|---|---|---|
| 1,508,871 | 9/1924 | Bloedow | 52/542 |
| 2,430,200 | 11/1947 | Wilson | 52/536 |
| 3,128,851 | 4/1964 | Deridder et al. | 52/588 |
| 3,152,669 | 10/1964 | Johnston | 52/588 |
| 3,420,027 | 1/1969 | Creveling | 52/542 |
| 3,606,718 | 9/1971 | Curran | 52/588 |
| 3,792,560 | 2/1974 | Naylor | 52/630 |
| 3,884,328 | 5/1975 | Williams | 52/588 |
| 4,031,683 | 6/1977 | Walker | 52/588 |
| 4,323,163 | 4/1982 | Johns | 211/189 |
| 4,450,970 | 5/1984 | Shepard | 52/36 |
| 4,531,331 | 7/1985 | Itagaki | 52/38 |
| 4,579,308 | 4/1986 | Jensen | 211/189 |
| 4,607,753 | 8/1986 | Radek | 52/36 |

FOREIGN PATENT DOCUMENTS

| | | | |
|---|---|---|---|
| 1524750 | 5/1968 | France | 52/588 |

*Primary Examiner*—William F. Pate, III
*Assistant Examiner*—Caroline D. Dennison
*Attorney, Agent, or Firm*—Nies, Webner, Kurz & Bergert

[57] ABSTRACT

A wall panel system comprises units of extruded plastic strips having vertically-spaced, horizontally-extending C-shape channels for receiving prongs or clips of various types of hangers. The channels are connected by lands against which a hanger engages. Along the top and bottom horizontal edges of the units are joint members by which like units are connected.

1 Claim, 2 Drawing Figures

WALL PANEL SYSTEM

OBJECTS

The primary object of this invention is to provide a wall panel system comprised of plastic extrusions adapted to receive and support either slat wall or cross bar hangers. More particularly, it is intended to provide a plastic panel having vertically spaced, horizontally-extending forwardly facing flat lands supported on the arms of vertically spaced, horizontally extending generally C-shaped channels as seen in vertical cross section, wherein the edges of the lands overhang the mouths of the channels and constitute lips onto which the prongs, clips or hooks of hangers can engage.

A further object is to provide a panel system comprised of units with vertically spaced, horizontally extending channels of extruded plastic, which units can be connected together by interlocking joints along their respective upper and lower horizontal edges, the point being that the units, being of extruded plastic, can be made of virtually any desired length (within practical limitations) and of any desired height, simply by interlocking the upper horizontal edge of a lower unit into the lower horizontal edge of the next upper unit. This is of particular advantage in the display panel for a store in that virtually any length or height of a store wall can be covered by the subject panel system, onto which articles on sale can be supported by hangers of various types.

Still another object is to provide a wall panel system comprised of vertically-spaced horizontally-extending C-shape panels wherein the bights of the channels constitute bases which engage against vertically extending metal stiffener strips, wherein the bases of certain adjacent ones of the channels have oppositely-extending flanges which define between them narrow slots for receiving screws by which the units are attached to the stiffener strips.

These and other objects will be apparent in the following specification and drawing in which.

Figure 1:
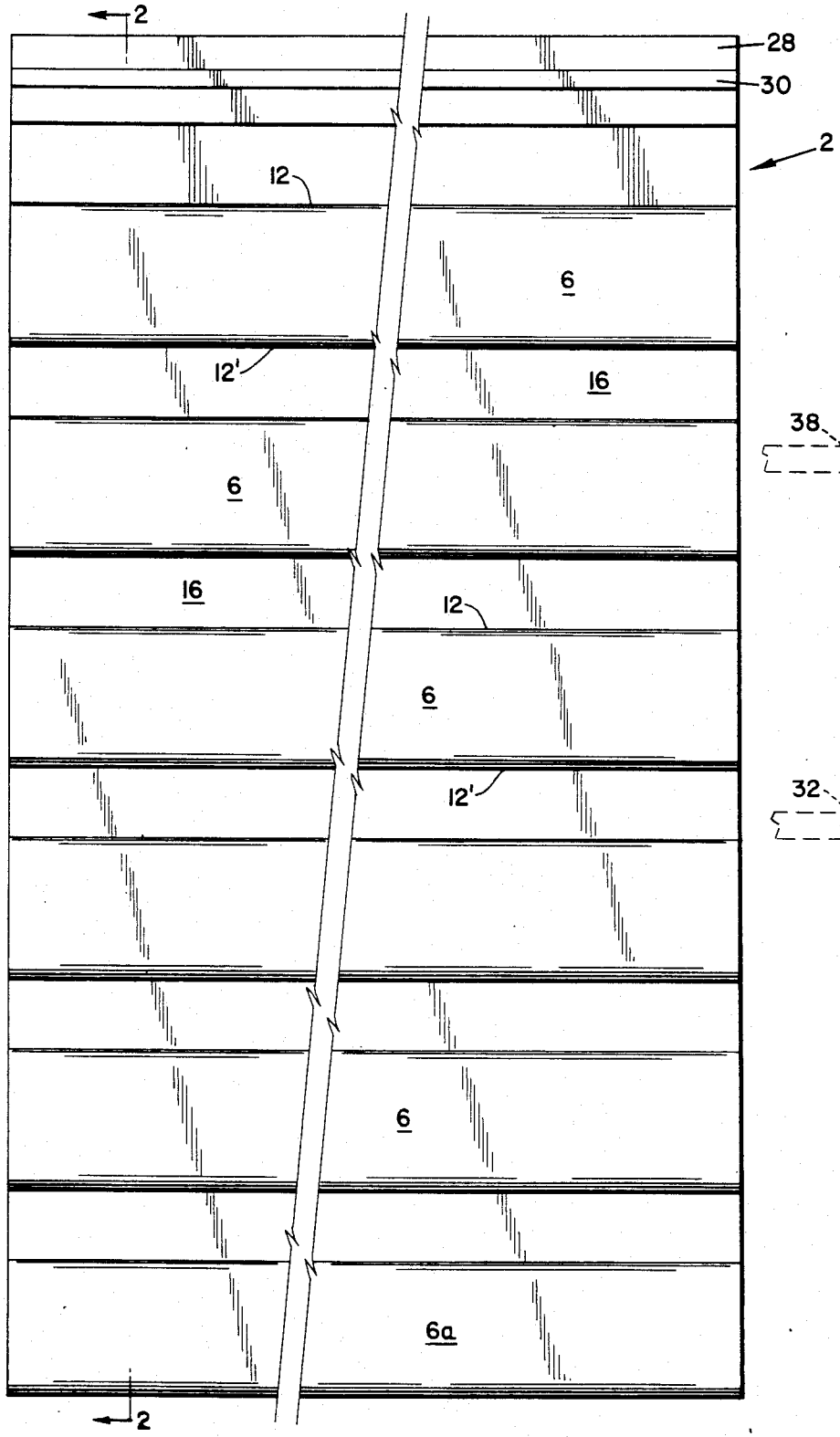
FIG. 1 is a front elevation of a panel unit.

Referring now to the drawing in which like reference numerals denote similar elements, the wall panel system 2 is comprised of extrudent plastic units 4 having forwardly-facing, horizontally-extending lands 6 supported on the ends of arms 8 of substantially C-shape forwardly-opening channels 10. The lips 12 of the lands overhang the mouths 14 of the channels and the bight 16 of the channels are flat. Some adjacent pairs of the channels have oppositely facing flanges 18 which define between them slots 20 for receiving the shanks of screws 22 by which the units are connected to stiffener strips 24.

Figure 2:
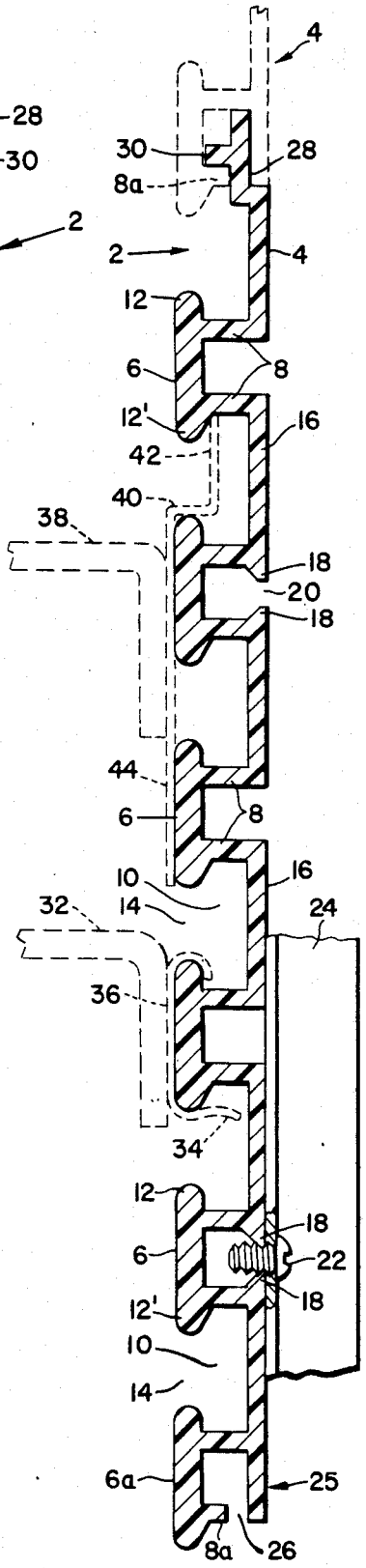
FIG. 2 is a vertical cross section along the line 2—2 showing a preferred form of a panel unit having a cross bar hanger and a slat wall hanger, both shown in broken lines, attached thereto.

Cooperating joint parts are provided along the upper and lower edges of the units. Referring to FIG. 2, the joint part along the lower edge of a unit is constituted by a land **6*a* which forms one side of an open-ended box B, the next adjacent side of the box being constituted by an arm 8*b* of the next adjacent channel 10. The third side of the box is provided by wall 25 which is integral with arm 8*b*, the fourth side of the box being a stub arm 8*a* which depends from land 6*a* and which terminates short of the wall 25 to provide a gap 26** therebetween.

The part of the joint along the upper edge of a unit is constituted by a "T"-shape flange 28, the head of the "T" engaging through the gap **8*a* of the other joint part and the stem of the "T" constituted by the rib 30 engages behind the stub arm 6*a*. The head of the "T" engages against the wall 25 of the other joint part. The flange 28 along the upper edge of one unit engages end-wise in the box b so that the adjacent units 4** are securely locked together and will not come apart, even when the lands are heavily loaded by hangers.

In the lower portion of FIG. 2 there is shown in broken lines a cross bar hanger 32 mounted onto a unit by means of a spring clip 34 which snaps over the lips 12 on a land 6. The spring clip has a flat base 36 which engages against the flat face of a land 6 so that the hanger is held firmly in place.

In the upper portion of FIG. 2 there is shown in broken lines a slat wall hanger 38 mounted onto a unit by means of a prong 40, an arm 42, of which engages behind the thickened lip 12' of lands 6, and the base 44 of the hanger engages against the flat faces of two adjacent lands 6.

I claim:

1. A wall panel comprised of extruded plastic units, each having a plurality of forwardly-facing vertically-spaced, horizontally-extending similar flat lands supported on the ends of arms of C-shape channels having forwardly open mouths, the longitudinal edges of the lands constituting lips which overhang the channel mouths and which are adapted to be engaged by mounting clips, prongs and the like of hangers, and joint means having cooperating parts which extend along upper and lower horizontal edges of the units for securing a lower edge of an upper unit to an upper edge of the next lower unit, wherein that part of the joint means which is on the lowermost edge of an upper unit is supported on one arm of a channel and, together with said one arm, respectively define first and second adjacent sides of an open-ended generally rectangular box, a third side of said box being constituted by a wall parallel to and spaced from the lowermost land, the fourth side of the box being spaced from and parallel to said second adjacent side and terminating short of the third side of the box and providing therebetween a gap, the part of the joint means extending along the upper edge of the next lower unit comprising an inverted "T"-shape flange as seen in cross section, said flange slideably engaging endwise in the box of the other joint part with one end of the head of the inverted "T"-shape flange engaging in said gap, the stem of the inverted "T"-shape flange engaging behind the fourth side of the box and the head of the inverted "T"-shape flange engaging against the third side of the box.

* * * * *